US006221234B1

(12) United States Patent
Mancia et al.

(10) Patent No.: US 6,221,234 B1
(45) Date of Patent: Apr. 24, 2001

(54) METHOD FOR PICKLING PRODUCTS OF A METAL ALLOY IN ABSENCE OF NITRIC ACID AND FOR RECOVERING EXHAUSTED PICKLING SOLUTIONS AND APPARATUS THEREFORE

(75) Inventors: Franco Mancia, Rome; Sandro Fortunati, Terni, both of (IT)

(73) Assignee: Acciai Speciali Terni S.p.A., Terni (IT)

( * ) Notice: Subject to any disclaimer, the term of this patent is extended or adjusted under 35 U.S.C. 154(b) by 0 days.

(21) Appl. No.: 09/367,938

(22) PCT Filed: Feb. 25, 1998

(86) PCT No.: PCT/IT98/00038

§ 371 Date: Nov. 30, 1999

§ 102(e) Date: Nov. 30, 1999

(87) PCT Pub. No.: WO98/38353

PCT Pub. Date: Sep. 3, 1998

(30) Foreign Application Priority Data

Feb. 25, 1997 (IT) ..... RM97A0102

(51) Int. Cl.[7] ..... C25B 1/00

(52) U.S. Cl. ..... 205/477; 205/483; 205/497; 205/746; 205/747; 204/232; 204/263; 204/230.2; 204/252; 204/292; 204/293; 204/294; 204/296

(58) Field of Search ..... 204/232, 263, 204/230.2, 252, 292, 293, 294, 296; 205/477, 483, 497, 796, 747

(56) References Cited

FOREIGN PATENT DOCUMENTS

| | | |
|---|---|---|
| 39 37 438 | 8/1990 | (DE) . |
| 44 07 448 | 9/1995 | (DE) . |
| 195 32 784 | 3/1997 | (DE) . |
| 0 435 382 | 7/1991 | (EP) . |
| 0 585 207 | 3/1994 | (EP) . |
| WO 97/43463 | 11/1997 | (WO) . |

*Primary Examiner*—Kathryn Gorgos
*Assistant Examiner*—Christopher Keehan
(74) *Attorney, Agent, or Firm*—Browdy and Neimark

(57) ABSTRACT

A method for pickling products in a metal alloy containing iron, and products in titanium and alloys thereof, in the absence of nitric acid as an oxidizing agent, and for the recovery of the exhausted solutions, characterized in that the recovery of the exhausted solutions deriving from pickling comprises the following steps: sending of the pickling solution, both as catholyte and as anolyte, in an electrochemical cell optionally of the membrane type to separate the $Fe^{2+}$ (or $Ti^{2+}$) ions to be disposed of, from the $Fe^{3+}$ (or of the $Ti^{3+}$ and $Ti^{4+}$) ions to be recovered, obtained by reduction at the cathode of the $Fe^{3+}$ ions which are in the catholyte to $Fe^{2+}$ (or of the $Ti^{3+}$ and $Ti^{4+}$ ions to $Ti^{2+}$) and of oxidation at the anode $Fe^{2+}$ (or $Ti^{2+}$) ions which are in the anolyte to $Fe^{3+}$ (to $Ti^{3+}$ and $Ti^{4+}$); treating the catholytic solution coming out of the cell and enriched in $Fe^{2+}$ (or $Ti^{2+}$) ions as to allow the separation in two phases, a first phase containing the metal canions $Fe^{2+}$, $Cr^{3+}$, $Ni^{2+}$ (or $Ti^{2+}$) to be disposed of and a second liquid phase deprived of said metal cations to be sent in the pickling bath; and sending the anolytic solution, coming out of the cell and enriched in $Fe^{3+}$ ions (or $Ti^{3+}$ or $Ti^{4}$+), in the pickling bath. It is also the object of the present invention an apparatus thereof.

14 Claims, 2 Drawing Sheets

Figure 1:
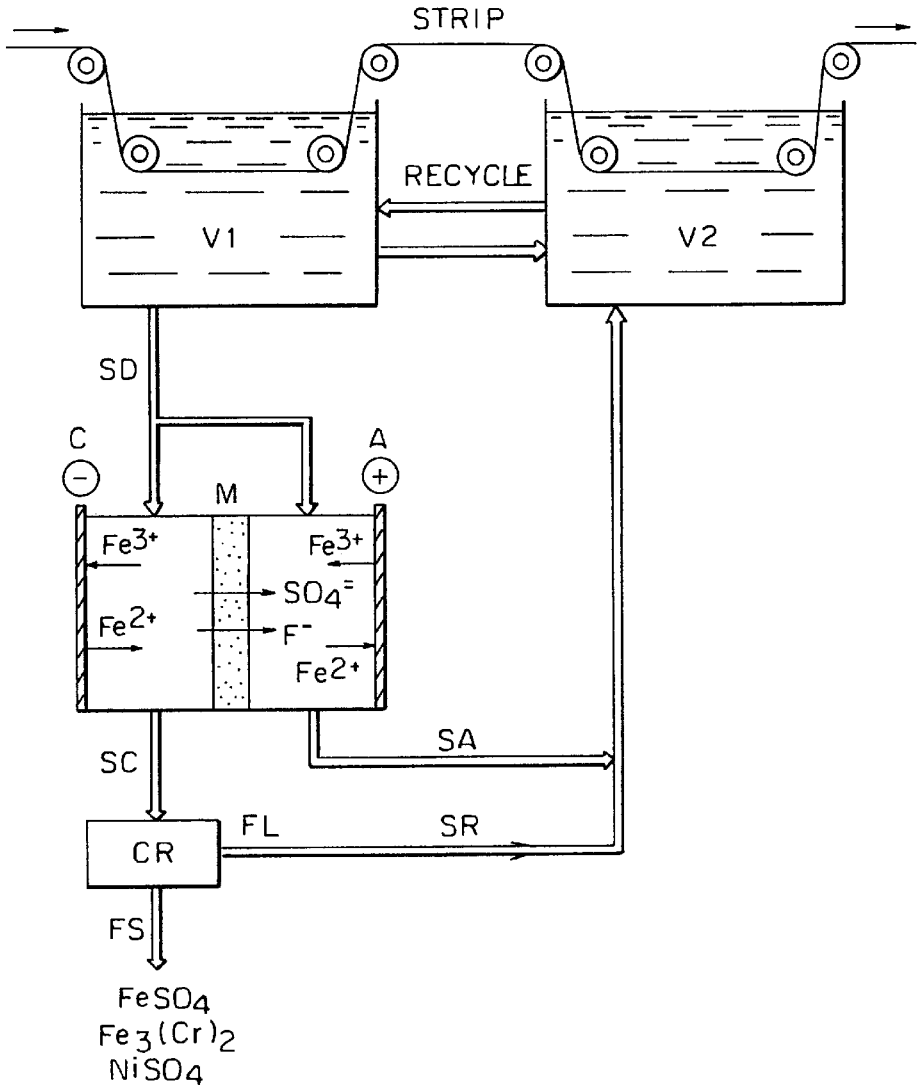

SD - PICKLING SOLUTION
SC - CATHODE SOLUTION
SA - ANOLYTE SOLUTION
M - MEMBRANE
C - CATHODE
A - ANODE
CR - CRYOSTAT/SEPARATOR

V1 - PICKLING SOLUTION
V2 - PICKLING BATH
FL - LIQUID PHASE
FD - SOLID PHASE

SD - PICKLING SOLUTION
SC1- FIRST CATHOD SOLUTION
SC2- SECOND CATHODE SOLUTION
SA - ANOLYTE SOLUTION
M1 - FIRST MEMBRANE
C1 - FIRST CATHODE
A - ANODE
CR - CRYOSTAT/SEPARATOR

V1 - PICKLING BATH
V2 - PICKLING BATH
SR - RECOVERED SOLUTION
M2 - SECOND MEMBRANE
C2 - SECOND CATHODE
FL - LIQUID PHASE
FD - SOLID PHASE

METHOD FOR PICKLING PRODUCTS OF A METAL ALLOY IN ABSENCE OF NITRIC ACID AND FOR RECOVERING EXHAUSTED PICKLING SOLUTIONS AND APPARATUS THEREFORE

CROSS REFERENCE TO RELATED APPLICATION

The present application is the national stage under 35 U.S.C. 371 of PCT/IT98/00038, filed Feb. 25, 1998.

DESCRIPTION

The present invention relates to a method for pickling products made of a metal alloy containing iron and, more specifically, to a pickling process for stainless steels characterized in that it avoids the use of nitric acid as an oxidizing agent and for the recovery of the exhausted solutions deriving from the pickling bath. Object of the present invention is also an apparatus thereof.

The present invention can also be applied for pickling of titanium and alloys thereof, of nickel and alloys thereof, of superstainless steels and for the related recovery of the exhausted solutions from the bath.

It is known that pickling is the process used to remove the layer of oxidation that forms as a result of heat treating of steel, to eliminate the layer depleted in chrome (dechromized layer) below the scale and to allow an efficient final passivation of the surface. In order to achieve an effective pickling process for stainless steels and titanium, a mixture of nitric acid ($HNO_3$) and hydrofluoric acid (HF) is normally used, at a temperature that generally varies between 60 and 75° C.

However, the use of nitric acid causes serious environmental problems, which result from the following:

- a considerable presence in the vapours over the pickling bath of nitrogen oxides ($NO_x$), which are developed by the pickling bath itself;
- the formation of exhausted solutions which generate nitrate-rich sludge to be disposed of;
- the high cost of disposal for waste products containing nitrates.

To overcome the above difficulties, a number of different methods have been drawn up in which reduction or elimination of the use of nitric acid in chemical pickling processes has been foreseen, and which are based on the use of a number of oxidants, added to the bath as reactive agents, among which, for example, it is possible to include permanganates, persulphates, ferric chloride, hydrogen peroxide ($H_2O_2$), or mixtures thereof. Hydrofluoric acid is always used in the pickling bath, in combination with various mineral acids (generally mixtures of acids), among which: sulphuric acid, hydrochloric acid, phosphoric acid.

The typical concentration of the above mentioned acids and compounds normally used in said pickling methods in absence of nitric acid can be summarized as following (for the stainless steel):

- free HF=5~50 g/l;
- free $H_2SO_4$=50~200 g/l;
- free HCl=0~50 g/l;
- $Fe^{3+}$>20 g/l (obtained by adding calculated quantities of hydrogen peroxide);
- $Fe_{tot}$ ($Fe^{2+}$+$Fe^{3+}$)=80 g/l.

From JP-A-50133125 (see Abstract Nr. 139369y, in CHEMICAL ABSTRACTS, Vol. 84, Nr. 20, May 17, 1976, Columbus, Ohio, US) and from EP-A-585207 is known a process for the elctrolytical recover of pickling solutions for metal surfaces. However in the above references the pickling solution is only in one compartment of the cell. From EP-A-435382 is known a process for the electrolytical recover of pickling solutions for metal surfaces, in which process is provided a step of recovering the pickling oxidizers by sending the pickling solution to the catholyte and then to the anolyte of the electrolytic cell. However, there is no hint of how to recover the acids and the compounds from the pickling bath.

Furthermore, a method for pickling products made of metal alloys containing iron and titanium and alloys thereof is known as an alternative and described in the Italian patent application No. RM96A000849. Said method foresees as oxidizer directly the $Fe^{3+}$ ion (in case of alloys of iron) or the $Ti^{3+}$ and $Ti^{4+}$ ions (in case of titanium alloys). In this case, the required concentration of $Fe^{3+}$ is not obtained by adding precise quantities of $H_2O_2$, but by electrochemical oxidation of the ion $Fe^{2+}$ to $Fe^{3+}$ in an electrolytic cell, using the same pickling bath as electrolyte.

Therefore, the object of the present invention is to provide a method for pickling products of a metal alloy containing iron, and products of titanium and alloys thereof, and products of nickel and alloys thereof in absence of nitric acid as oxidizing agent, the method being characterized in that it provides the recovery of exhausted pickling solutions.

More specifically, the present invention provides a method that foresees the recovery of the total hydrofluoric acid in the exhausted solutions coming from the pickling baths.

Furthermore, the present invention provides a method that foresees the recovery of free sulphuric acid from the exhausted solutions coming from the pickling baths.

Furthermore, the present invention provides a method that foresees the recovery of total hydrochloric acid (and/or the other possible acids) of the exhausted solutions coming from the pickling baths.

Another object of the present invention is to provide a method for the recovery of the $Fe^{3+}$ ions coming from the exhausted solutions of the metal products from the pickling baths containing iron and alloys thereof (or $Ti^{3+}$ and $Ti^{4+}$ for titanium and alloys thereof).

A further object of the present invention is to provide a method that foresees the separation and the possible precipitation of metal ions $Fe^{2+}$, $Cr^{3+}$, $Ni^{2+}$ and $Ti^{2+}$, that are to be disposed of.

According to the present invention, a method for pickling products of a metal alloy containing iron, and of titanium products and alloys thereof, in absence of nitric acid as oxidizing agent is provided, and for the recovery of exhausted pickling solutions, comprising the step of dipping the product to be pickled in an aqueous solution of sulphuric acid, hydrofluoric acid and, optionally, phosphoric and hydrochloric acid and in absence of nitric acid, the oxidizing agent of the pickling solution being the ferric ion, or titanium(III) and titanium(IV) ions, the method being characterized in that the recovery of the exhausted pickling solutions comprises the following steps:

sending the pickling solution, both as catholyte and as anolyte, in an electrolytic cell optionally of the membrane type in order to:

a) separate the $Fe^{2+}$, or $Ti^{2+}$, ions to be disposed of, from the $Fe^{3+}$ (or $Ti^{3+}$ and $Ti^{4+}$) ions to be recovered, obtained by reduction at the cathode of the $Fe^{3+}$ ions to $Fe^{2+}$, or $Ti^{3+}$ and $Ti^{4+}$ ions to $Ti^{2+}$, and by oxidation at the anode of $Fe^{2+}$, or $Ti^{2+}$, ions to $Fe^{3+}$ or to $Ti^{3+}$ and $Ti^{4+}$ ions;

b) recover $F^-$ as HF, complexed with $Fe^{3+}$ in the catholyte, by reduction of the $Fe^{3+}$ ion to $Fe^{2+}$ with consequent dissolution of the complex and release of the $F^-$ ion;

treating the catholyte coming out of the cell and enriched in $Fe^{2+}$, or $Ti^{2+}$, ions as to allow the separation in two phases, a first phase containing the metal cations $Fe^{2+}$, $Cr^{3+}$, $Ni^{2+}$, or $Ti^{2+}$, to be disposed of and a second liquid phase deprived of said metal cations to be sent in the pickling bath; and sending the anolyte, coming out of the cell and enriched in $Fe^{3+}$ ions or in $Ti^{3+}$ and $Ti^{4+}$ ions in the pickling bath.

According to an embodiment of the invention, the method foresees that the anodic reaction and the corresponding cathodic one in the cell are potentiostatically or galvanostatically controlled.

In case of alloys containing iron, the electrode potential at the anode is preferably comprised between 771 SHE (corresponding to Erev in the pair $Fe^{2+}/Fe^{3+}$) and 1229 mV SHE (corresponding to Erev in the oxygen development reaction) (SHE=standard electrode of hydrogen), in order to avoid development of oxygen.

In case of titanium and alloys thereof, the electrode potential at the anode is preferably comprised between −368 (corresponding to Erev pair $Ti^{3+}/Ti^{2+}$) and 1229 mV SHE.

The electrode potential at the cathode is preferably $\geqq 0$ mV SHE (to avoid the development of hydrogen).

According to a second embodiment of the present invention, a three-compartment cell can be provided, the cell having an anodic compartment using a pickling solution as anolyte and wherein occurs the oxidation reaction:

a) $Fe^{2+} \rightarrow Fe^{3+}$ (or $Ti^{2+} \rightarrow Ti^{3+}$ and $Ti^{4+}$)

according to the described method, and two cathodic compartments, wherein a first compartment has a pickling solution as catholyte where occurs the cathodic reaction:

b) $Fe^{3+} \rightarrow Fe^{2+}$ (or $Ti^{+}$ and $Ti^{4+} \rightarrow Ti^{2+}$)

according to the described method, and a second compartment wherein the used catholyte is a sulphuric acid solution and wherein, in this case, the reaction of development of hydrogen is desired, and occurs with potentials $E \leqq 0$ mV SHE.

The catholyte of second the compartment (which is a sulphuric acid solution) is finally send out continuously from the cell into the pickling solution, to reintegrate the $H_2SO_4$ that is consumed during the pickling reaction.

The advantages of this second embodiment are that in this case the cell works not only as separating member in the exhausted solution of the $Fe^{2+}$ ions from the $Fe^{3+}$ ions (or the respective titanium ions), but it can also provide the needed quantity of $Fe^{3+}$ ions (or the respective Titanium ions) that are needed to carry out, as oxidizing agents, the primary pickling reaction, to the anode as it will be explained in greater detail herebelow.

Furthermore, the method according to the invention foresees (in both embodiments) the recovery of the pickling solution to be continuous, by circulation of the anolyte in pickling bath, or discountinous.

The pickling bath has a temperature preferably comprised between 45 and 85° C.

The pickling solution (to be used both as catholyte and as anolyte of the described cell) is made up of an aqueous solution of sulphuric acid, of hydrofluoric acid and optionally of hydrochloric and phosphoric acid, with the following composition:

free HCl from 0 to 50 g/l free $H_3PO_4$ from 0 to 200 g/l free $H_2SO_4$ from 50 to 200 g/l free HF from 5 to 50 g/l $Fe^{3+}$ (or $Ti^{3+}$+$Ti^{4+}$) >20 g/l $Fe_{tot}$ (or $Ti_{tot}$)in solution $\leqq 50$ g/l Furthermore, the products containing iron for which the method according to the present invention are applicable are selected from the group comprising:

Stainless steel, laminated or in any case hot and/or cold worked steel, in particular austenitic, ferritic, duplex and superstainless steel;

Ni-based super-alloys.

Furthermore, the products containing titanium for which the method according to the present invention is applicable are selected from the group comprising:

CP (commercial purity) Titanium of various grades;

Titanium alloys.

Figure 2:
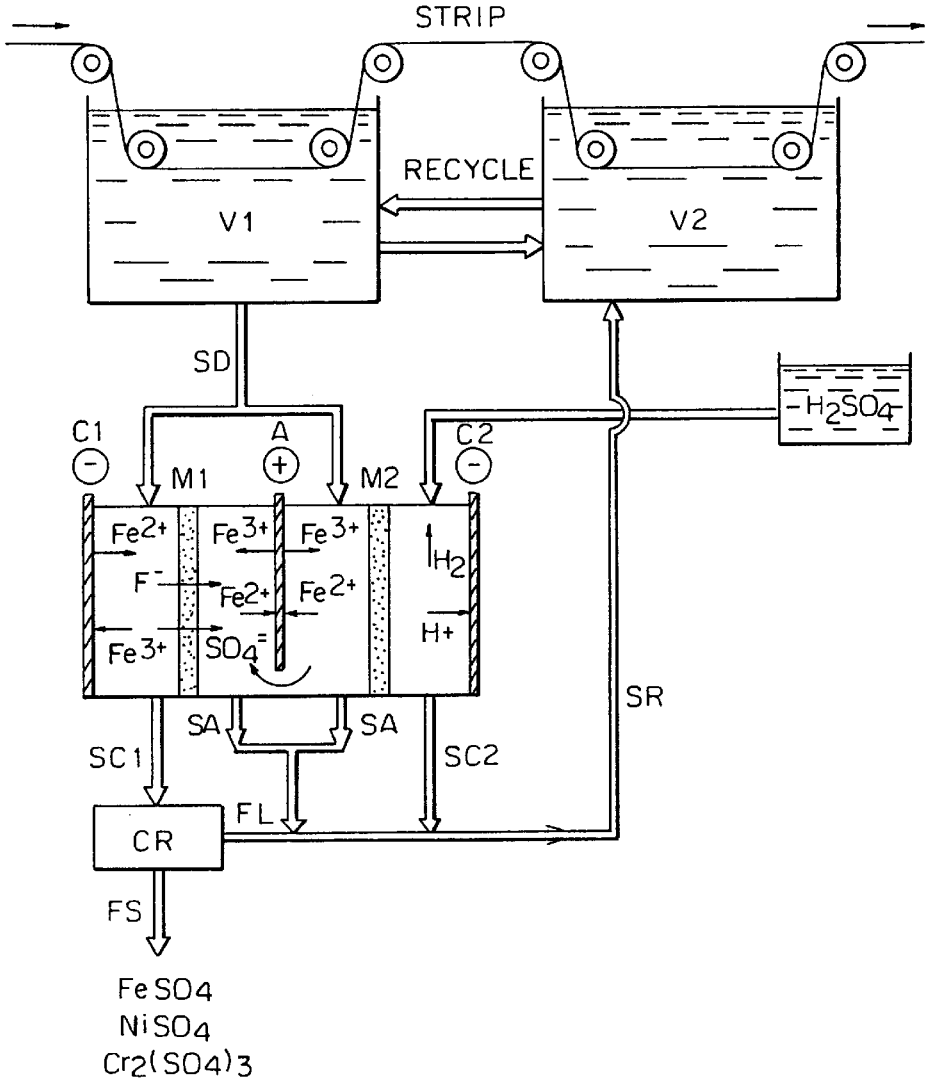

The present invention will be more clearly illustrated in the following detailed description of a preferred embodiment thereof, given merely as a non-limiting example, with reference to the enclosed figures, in which:

FIG. 1 shows in a schematic view of a first embodiment of an apparatus for the pickling and recovering of the exhausted solution, according to the present invention; and FIG. 2 shows a in schematic view of a second embodiment of an apparatus for the pickling and recovering of the exhausted solution, according to the present invention.

The recovery of iron III ($Fe^{3+}$) (and/or titanium III or IV) is one of the best assets of the method according to the present invention, as it forms the main oxidizing element in the pickling baths deprived of nitric acid.

Substantially, the recovery of $Fe^{3+}$ (or $Ti^{3+}$ and $Ti^{4+}$) as oxidizers is considerably cost-saving, as it reduces the quantity bf hydrogen peroxide required to obtain $Fe^{3+}$ during the pickling by the oxidation of the $Fe^{2+}$ ion which is in the bath (the analogous situation occurs with the titanium ions). Moreover, the hydrogen peroxide is definitely the most expensive reactive in which are considered pickling process in absence of nitric acid.

The method of the present invention relies basically on the following principles.

The exhausted solution to be treated, after (if necessary) decantation and filtration to separate solid parts (e.g. scales of oxidation from the pickled surfaces) undergoes the following main treatments (reference is made to metal alloys containing iron, being the case of titanium and alloys thereof completely analogous):

a) a treatment in electrolytic cell, optionally of the membrane type, for the cathodic reduction of the $Fe^{3+}$ ions(which are in the pickling bath sent to the cell as catholyte) to $Fe^{2+}$ until reaching the optimum $Fe^{3+}$ concentration value.

b) a cooling treatment of the catholyte solution treated in the cell by means of a cryostat, allowing the precipitation of the metals ($Fe^{2+}$; $Cr^{3+}$; $Ni^{2+}$) as inert sulphate crystals (crystallization treatment);

c) separation of the liquid phase from the precipitated phase;

d) the so separated liquid phase is sent as recovered liquid directly in the bath; and e) a corresponding treatment in the same electrolytic cell of the membrane type for the anodic oxidation of the $Fe^{2+}$ ions(which are in the pickling bath sent in the cell as anolyte) to $Fe^{3+}$, and recovery in the bath of the same anolyte solution.

However, the following conditions should be noted:

i) during the cathodic treatment, occurs the reduction: $Fe^{3+}+e \rightarrow Fe^{2+}$, therefore the concentration of $Fe^{3+}$ decreases at the expenses of the cell (cathodic) current;

ii) during the anodic treatment, the inverse reaction occurs, i.e. oxidation: $Fe^{2+} \rightarrow Fe^{3+}+e$ always at the expenses of the cell (anodic) current;

iii) the total net balance (anodic+cathodic cell reaction) indicates that there is no total variation in the total quantity of ferrous or ferric ions, i.e. no net reduction (or oxidation) occurred; in other words, with respect to the initial solution (exhausted to be treated) only a separation of $Fe^{2+}$ and $Fe^{3+}$ ions is obtained at the expenses of the cell current and more precisely an enrichment of the catholytic solution in ferrous ions ($Fe^{2+}$) and a simultaneous enrichment of the anolytic solution in ferric ions ($Fe^{3+}$); therefore, the final result is a total transfer of $Fe^{2+}$ ions towards the catholyte and a total transfer of $Fe^{3+}$ ions towards the anolyte.

Successively, the catholytic solution is sent to a crystallization treatment for cooling by means of a cryostat. The temperature used depends on the initial concentrations as it is easier to obtain the formation of sulphate crystals with solutions having a higher iron concentration. This aspect is very important, as it influences directly the choice of operative conditions for the pickling process itself: briefly, it is better to perform the pickling with solutions that are sufficiently enriched in iron in solution, before the renewing (totally or partially by dilution) of the pickling solution.

During the cooling treatment of the catholytic solution, a precipitation (crystallization) of iron sulphates (besides that of chrome and nickel) occurs. Such precipitation is selective, as that of ferrous sulphate is more likely to take place with respect to the ferric sulphate. Therefore, in the liquid phase the $Fe^{3+}$ ion remains in solution together with the free sulphuric acid (i.e. not precipitated as sulphate) and the other acids (HF, HCl, $H_3PO_4$) that do not take place in the formation of the crystals.

On the basis of what explained, the previously described treatment of enrichment of the cathodic solution in ferrous ions, has a first considerable advantage of increasing the crystallization temperature, facilitating therefore this operation, just because the solution is more concentrated in the kind easier to precipitate ($Fe^{2+}$).

A second important advantage is that, during the treatment in cell of the catholyte at a certain temperature of the crystallization treatment, the optimal concentration of $Fe^{3+}$ as abovementioned can be reached, wherein the precipitation of ferric sulphate together with ferrous sulphate no longer occurs, but only that of ferrous sulphate. Therefore, it is not necessary to carry out the cathode reduction until the complete elimination of the $Fe^{3+}$ ion, as this one is recovered in the liquid phase. After the crystallization treatment, an inert precipitate is obtained ($Fe^{2+}$, $Ni^{2+}$, $Cr^{3+}$ sulphates), together with a liquid solution rich in $Fe^{3+}$ and acids. Then after precipitation, a treatment to separate the solid phase from the liquid phase is performed.

The liquid solution thus obtained (rich in $Fe^{3+}$ and recovered acids $H_2SO_4$, HF and HCl) is sent again to the pickling bath. In such a way, according to the invention hereby described, a remarkable total recovery of the $Fe^{3+}$ ions as oxidizer species in the pickling bath is obtained (for "total recovery" it is to be understood the recovery of $Fe^{3+}$ ions deriving from the liquid solution separated after crystallization and those deriving from the anolyte of the cell and recirculated in the bath).

It has to be noted that the precipitated sulphates are Iron(II), Nickel and Chrome. In particular, it is to be underlined that the chrome ion precipitated as sulphate has definitely valence 3+ and not 6+, as the solution was treated cathodically at a potential where the $Fe^{2+}$ ion is formed from $Fe^{3+}$, therefore at potential values $E \leqq 771$ mV SHE.

At these potentials, also the possible $Cr^{6+}$ is definitely reduced to $Cr^{3+}$, the value of Erev of the pair $Cr^{3+}/Cr^{6+}$ corresponding to 1235 mV SHE.

As to the recovery of HF from the cathodic solution, what follows as to be taken into consideration.

The fluorine ion assembles easily with $Fe^{2+}$ and $Fe^{3+}$. Of these two, the most favorite and stable one is that with $Fe^{3+}$ During the cathodic treatment, the concentration of $Fe^{3+}$ is progressively reduced, therefore the most stable assembly of $F^-$ with $Fe^{3+}$ dissolves with the release of hydrofluoric acid. Furthermore, as the precipitation of ferrous sulphate is favorite with respect to a possible precipitation of ferrous fluoride, $Fe^{2+}$ is eliminated from the balance b, with a further release of hydrofluoric acid. As a consequence, the initial total hydrofluoric acid (i.e. that combined with iron besides to that already free from the beginning) can be found again in the separated liquid solution.

In absence of the described treatments, the complexed fluoride ion, and therefore the hydrofluoric acid, would be lost as it would end up in the precipitated as complexed with $Fe^{3+}$.

It is to be underlined that the hydrofluoric acid, just like the hydrogen peroxide, is a very expensive agent, and costs much more than the sulphuric acid. The present invention allows the total recovery of the hydrofluoric acid, while the sulphuric acid recovered is the free one, the rest being precipitated as metal sulphate.

From what previously exposed it is evident that as to perform efficiently and conveniently both the pickling and the recovery, they have to be considered as part of a single integrated method of pickling-recovering.

In fact, it would be convenient to perform the pickling and the recovery in continuous, with a pickling solution having the lowest possible quantities of $Fe^{3+}$ and the highest $Fe^{2+}$, as to reduce the importance of the described performance of enrichment of $Fe^{2+}$ in cathodic solution. On the other hand, the need to work with the highest possible concentration of $Fe_{(tot)}$ to ease crystallization was already seen, while in the industrial line during the pickling a certain balance $Fe^{3+}/Fe^{2+}$ has to be kept to guarantee the needed potential redox of the pickling solution. Therefore, the choice of the working conditions has to take into consideration the Is optimization of the various necessities deriving from the particular pickling and recovery processes adopted.

In the common use, it is better to perform the pickling with a not too high concentration of $Fe_{tot}=Fe^{2+}+Fe^{3+}$ (e.g., max. 80–90 g/l), to avoid undesired precipitation in the cathodic part of the cell. Furthermore, a not too high concentration of $Fe_{tot}$ makes the pickling solution more efficient, especially for low concentration of $Fe^{3+}$ (e.g., $Fe^{3+} \leqq 30$–40 g/l).

Referring now to FIG. 1, a first embodiment of the pickling and recovery system of the exhausted solution of products containing iron (or titanium and alloys thereof) according to the method of the present invention is schematically shown. For ease of description, reference will be made to metal alloys containing iron, being the titanium alloys analogous. It is to be considered that pickling is normally performed in two separated baths, wherein the first is more loaded in metals, as most of the dissolution of the metal alloys occurs therein. For example, working in continuous in counterflow, the second bath (less loaded in metals and less aggressive) is used to dilute the first in counterflow. From the first bath, always in continuous, the solution to be treated for the recovery is sorted out as exhausted. Typically, the features of this solution are as follows:

T=65° C.

Total Fe ($Fe^{2+}$+$Fe^{3+}$)=90 g/l $Fe^{2+}$=50 g/l $Fe^{3+}$=40 g/l $H_2SO_4$=150 g/l HF=35 g/l Said solution is sent to a cell forming therein the catholyte, where the reduction from $Fe^{3+}$ to $Fe^{2+}$ occurs. Outcoming of the cell, the catholyte has the following concentration:

$Fe^{2+}$=65 g/l $Fe^{3+}$=25 g/l

Meanwhile, the same initial solution coming from the pickling bath is sent, for example in the same quantity as above, in the anodic compartment of the cell (i.e. in the anolyte) wherein the oxidation of $Fe^{2+}$ to $Fe^{3+}$ occurs. Outcoming of the cell, the concentrations are as follows:

$Fe^{2+}$=35 g/l $Fe^{3+}$=55 g/l

Then, such anolytic solution is sent to the pickling bath.

Successively, the catholytic solution treated in the cell is cooled down to −10° C. Crystals of ferrous sulphate, besides those of $Ni^{2+}$ and $Cr^{3+}$, are obtained. At the used temperature (−10° C.) with the used concentration of $Fe^{3+}$, corresponding to 15 g/l, there is no precipitation of sulphate or ferric fluoride (or chloride).

Then, the liquid phase is successively separated from the crystals and sent back to the bath, and it is characterized by the following concentrations:

$Fe^{2+}$=20 g/l $Fe^{3+}$=30 g/l $H_2SO_4$=170 g/l

HF=40 g/l.

Obviously, to calculate the efficiency of the described recovery system, the total mass balance (initial mass of cathodic solution=mass of solid elements+separated liquid solution) has to be considered and, according the described example, the following values are obtained:

recovery efficiency of $Fe^{3+}$≧95% recovery efficiency of HF≧95% recovery efficiency of $H_2SO_4$≧95%

It is to be pointed out that, as to the optional recovery of HCl (or other acids such as $H_3PO_4$), this occurs without particular problems, considering the higher solubility of chlorides with respect to sulphates, that therefore remain in a liquid phase after cooling.

The cell in FIG. 1 is of the membrane type, to avoid the partial migration (or back-scattering) of the ions (in particular $Fe^{2+}$ and $Fe^{3+}$) between the two compartments, caused by the different ion concentration between anolyte and catholyte after the described processes of oxidation/reduction. In fact, back-scattering tend to hinder the progressive and desired enrichment of $Fe^{2+}$ in the catholyte and of $Fe^{3+}$ in the anolyte and the membrane is to hold up such effect.

Furthermore, it is to be noted that the electric field has the positive effect of favouring the migration towards the anodic compartment of the acids (i.e. for example of the $F^-$ and $SO_4^=$ ions). Such migration is desired as from this compartment the acids are directly sent to the pickling bath, i.e. recovered.

From the description, it can be sorted out that the cell can be both an oxidation (at the anode) and a reduction (at the cathode) cell of the iron ions (respectively ferrous and ferric ions) for the separation of $Fe^{2+}$ from $Fe^{3+}$, and a cell of the selective membrane type, for the separation of the acids, according to the already known working method of the normal cells wherein a membrane of the selected type is used. In this case, the membrane must allow the preferential passage of the negative ions (anionic membrane) and hold up the passage of positive ions (metal).

According to the present invention, if anionic membranes are used, the cell can work using efficiently and at the same time both the above described effects. However, it is to be pointed out that the non selective membranes (whose choice would essentially favour the separation of $Fe^{2+}$ from $Fe^{3+}$) turn out to be cheaper and longer lasting. The numeric examples described herebelow refer, for ease of description but taken also as non limiting examples, to the latter type of membranes.

Furthermore, the choice of the electrodes is functional to the current efficiency and the overvoltages that are to be obtained, taking however into consideration the necessary investments. A favourite choice, both for its efficiency and cheapness, is the use of a graphite anode and cathode. This choice guarantees a current efficiency >95% and very low overvoltages for the reactions considered as oxidation and reduction of the iron ions.

Furthermore, (with reference to FIG. 1), a potentiostatic cell control is preferred, fixing the potential of the cathodic compartment at a value of some mV (practically comprised between 50–100 mV) below the Erev of the pair $Fe^{2+}/Fe^{3+}$ corresponding to 771 mV SHE. With this type of control, as it was already described, the potential reduction of Cr(VI) to Cr(III) is obtained. At the anode, because of the low system overvoltages, potential that are parallely placed between 50–100 mV above Erev are obtained. At the described potentials, no parasites or undesired reactions occur (e.g.: development of hydrogen at the cathode or development of oxygen at the anode, or plating of metals or oxidation at Cr(VI)).

It was proved during experimental conditions that the so described cell is easy to be galvanostatically controlled, as the reaction at the cathode $$Fe^{3+}+e \rightarrow Fe^{2+}$$

and the related reaction at the anode, occur both on the described electrodes at low overvoltage (i.e. imposing a desired current, the potentials at the cathode and at the anode move relatively little from their balance position), while at the same time the useful interval of potential for the desired reactions to occur is wide (practically, can be employed the whole interval between the development of hydrogen=0 mV SHE and 771 mV for the cathode and 771 mV up to 1229 mV SHE corresponding to the development of oxygen for the anode).

On the other hand, the galvanostatic control is easier to be performed at an industrial scale than the potentiostatic one.

Finally, it is to be pointed out that using a cell of the kind shown in FIG. 1, the pickling process works by using solutions without nitric acid, wherein the desired potential redox of the solution can be guaranteed either by adding oxidizing reactors (such as hydrogen peroxide) or by producing $Fe^{3+}$ in separated electrolytic cell.

Referring now to FIG. 2, a second embodiment of a pickling and recovery system of the exhausted solution according to the method of the present invention is schematically shown.

In this second embodiment, the cell is divided in three compartments, described herebelow together with the treatments thereof:

a) a first cathodic compartment (C1) (having the pickling solution as catholyte) wherein the reduction reaction $Fe^{3+}e \rightarrow Fe^{2+}$ occurs and the solution therein treated is sent to the crystallization treatment, as described for the catholyte of the Type I cell;

b) a second cathodic compartment (C2) wherein circulates as catholyte a solution of sulphuric acid (preferably, but also other acids can be used, such as HCl), and wherein the cathodic reaction of development of hydrogen essentially occurs, therefore at a potential $E \leqq 0$ mV SHE, according to $H_2SO_4+2e \rightarrow H_2+SO_4^{=}$;

the quantity of sulphuric acid to be put on, and therefore of $SO_4^{=}$ ions to be produced according to the reported cathodic reaction, corresponds to what it is strictly necessary to reintegrate the consumed iron, chrome and nickel sulphates (type $FeSO_4$) generated during the pickling process after the dissolution of the metal alloy. Said sulphates are then separated by crystallization during the previously described cooling treatment in cryostat;

c) an anodic compartment (central) (A) (with pickling solution as anolyte) wherein the parallel oxidation reaction:

$Fe^{2+} \rightarrow Fe^{3+}+$ occurs and;

the quantity of iron(II) oxidized to iron(III) corresponds in this case (in equivalents) to the sum (in equivalents) of the two cathodic reactions ($Fe^{3+} \rightarrow Fe^{2+}+e$; $2H^{+}+2e \rightarrow H_2$) occurring in the two cathodic compartments.

Furthermore, with reference to the reaction described in anode (A) the following must be specified:

i) a part (in equivalents) of $Fe^{3+}$ produced in (A) is equal to the quantity of $Fe^{3+}$ consumed by reduction in the first cathodic compartment (C1). In such a way, iron (III) is separated from iron(II) by the enrichment of iron(III) in the anodic compartment (where it is recovered) and the enrichment of iron(II) in the cathodic compartment (where it is directed to the successive disposal for precipitation as sulphate).

ii) the remaining part (in equivalents) of $Fe^{3+}$ produced in (A) constitutes the reintegrating oxidant sent to the pickling bath to support the primary pickling reaction (oxidation of the basic metal):

1) $Fe \rightarrow Fe^{2+}+2e$;

The total pickling oxidation/reduction reaction is obtained by the dissolution through oxidation of the (Fe) metal according to 1) and by the reduction of $Fe^{3+}$ to $Fe^{2+}$; therefore, the total reaction is:

2) $Fe+2Fe^{3+} \rightarrow 3Fe^{2+}$

Once the quantity of material to be dissolved during the pickling process is known (normally about 40 $g/m^2$ of the pickled surface for the austenitic stainless steels and about 80 $g/m^2$ for the ferritic ones), the quantity of $Fe^{3+}$ to be produced to support the reaction (2) is calculated.

The quantity of $Fe^{2+}$ ions produced by (1) is bound to be neutralized in the end with sulphates deriving from (C2) according to the following reaction:

3) $Fe^{2+}+SO_4^{=} \rightarrow FeSO_4$ to be then bound to the crystallization treatment and disposed of as precipitates (the quantity of desired sulphuric acid is thereby calculated).

A cell like the above described one of the type in FIG. 2 is definitely an integrated cell for the simultaneous performance of the pickling and the recovery process of the exhausted solutions.

Furthermore, as type of control of the cell for this second embodiment, both the galvanostatic and the potenziostatic seem to be possible. The anodic potenziostatic control is preferred between the anodic compartment (A) and the first cathodic compartment (C1), whereas between the anodic compartment (A) and the second cathodic compartment (C2) the galvanostatic control is preferred.

The cell in FIG. 2, that, as described can both separate the $Fe^{3+}$ ions from the $Fe^{2+}$ ions and the production of the quantity of $Fe^{3+}$ ions needed to support, as oxidizer, the primary pickling reaction according to reception 2, can also have one cathodic compartment. In this case, in the cathodic compartment both the reduction reaction from $Fe^{3+}$ to $Fe^{2+}$, and the discharge reaction of hydrogen (the solution is acid for sulphuric acid) must occur. At the same time, the oxidation of $Fe^{2+}$ to $Fe^{3+}$ will occur. However, to oxidize all the needed iron 3+, a higher quantity of anolytic solution will have to be used (practically at least the double of the catholitic quantity obtained in reaction 2), considering that the iron (Fe) oxidized during the pickling is disposed of as $Fe^{2+}$ (sulphate) according to the present invention. However, the three compartment solution shown in FIG. 2 allows a better global control of the process, besides having less risks of precipitation of ferrous sulphate directly in cell, being therefore preferred.

For the successive crystallization treatment by cooling (according to any of the embodiments of the invention), reference can be made to already known technologies. Between the possible types of cryostats tried for crystallization treatments, the cyclone systems turned out to be quite efficient, even if said systems originate relatively small solid particles that are then to be separated from the liquid part with difficult treatments. The growing of bigger and therefore easier to separate crystals, foresees methods having longer treatments times.

However, it is to be pointed out that, after the treatment in electrolytic cell according to both the above described first and second embodiments of the present invention, it is not necessary that the solution is sent to the cryostat treatment for the crystallizations of the metal. As an alternative, in fact, a different separation treatment of acids from metals can be provided, for examples with resins or selective membranes.

In this case, using only resins without pre-treatment in cell, a recovery of metals and acids of about 50% would be obtained, while pre-treatment in cell (downstream the resins) allows however higher percentages of final recovery, especially of hydrofluoric acid and of iron (III). However, crystallization is the final treatment offering the highest performances, as the recovery of acids and iron (III) is higher than 95%.

The present invention has as a further subject also an apparatus for pickling of products made of metal alloys containing iron and of products made of titanium and alloys thereof, and for recovery of the exhausted solutions deriving from pickling, comprising essentially the following units in combination: an anodic compartment; at least one cathodic compartment; at least one anode, selected from the group comprising: graphite, carbon or lead-based; at least a cathode, selected from the group comprising: graphite, lead, iron, stainless steel or Ni-based alloys; separation means between anolyte and catholyte; control means of the current of the cell selected from the group comprising galvanostatic and potentiostatic means; means for separating the metal cations from the catholitic solution; and means for sending the pickling solution both to the cathodic compartment and to the anodic compartment.

The separation means between anolyte and catholyte can be a selective membrane.

The means for separating the metal cations from the catholitic solution can be selected from the group comprising crystallisers of the cryostat type, ion exchanging resins and selective membranes.

What is claimed is:

1. A method for pickling products of a metal alloy containing at least one of $Cr^{3+}$, $Ni^{2+}$, iron, products of titanium and alloy thereof, comprising the step of dipping the product to be pickled in an aqueous solution of sulphuric acid, hydrofluoric acid and, optionally, phosphoric acid and/or of hydrochloric acid and in absence of nitric acid, using as oxidizing agent in the pickling solution ferric ion, or titanium(III) and titanium(IV) ions, and for recovering the exhausted pickling solutions, the method being characterized in that the recovery of the exhausted pickling solutions comprises the steps of:

sending the pickling solution, both as catholyte and as anolyte, in an electrolytic cell comprising a membrane to:

a) separate the $Fe^{2+}$, or $Ti^{2+}$, ions to be disposed of, from the $Fe^{3+}$, or $Ti^{3+}$ and $Ti^{4+}$, ions to be recovered, obtained by reduction at the cathode of the $Fe^{3+}$ ions to $Fe^{2+}$, or $Ti^{3+}$ and $Ti^{4+}$ ions to $Ti^{2+}$, and by oxidation at the anode of $Fe^{2+}$, or $Ti^{2+}$, ions to $Fe^{3+}$, or to $Ti^{3+}$ and $Ti^{4+}$ ions;

b) recover $F^-$ as HF, complexed with $Fe^{3+}$ in the catholyte, by reduction of the $Fe^{3+}$ ion to $Fe^{2+}$ with consequent dissolution of the complex and release of the $F^-$ ion ;

treating the catholyte coming out of the cell and enriched in $Fe^{2+}$, or $Ti^{2+}$, ions as to allow the separation in two phases, a first phase containing the metal cations $Fe^{2+}$, $Cr^{3+}$, $Ni^{2+}$, or $Ti^{2+}$, to be disposed of and a second liquid phase deprived of said metal cations to be sent in the pickling bath; and sending the anolyte, coming out of the cell and enriched in $Fe^{3+}$ ions, or in $Ti^{3+}$ and $Ti^{4+}$ ions, in the pickling bath.

2. A method for pickling products of a metal alloy containing iron, and products of titanium and alloys thereof, according to claim 1, wherein said step of treating the catholytic solution to separate the metal cations $Fe^{2+}$, or $Ti^{2+}$, $Cr^{3+}$, $Ni^{2+}$ to be disposed of and therein contained is chosen from the following treatments:

separation as inert sulphates by crystallization through cooling;

separation through exchanging resins of the ions;

separation through selective membranes.

3. A method for pickling products of a metal alloy containing iron, and products of titanium and alloys thereof, according to claim 1, wherein the membrane of the cell is of an anionic selective membrane, allowing the preferential passage only of the negative ions, therefore separating also the acids anions, $SO_4^=$, $F^-$, $Cl^-$, $HPO_4^=$, that migrates towards the anolyte, from where they are successively sent in the pickling bath for their recovery.

4. A method for pickling products of a metal alloy containing iron, and products of titanium and alloys thereof, according to claim 1, wherein the electrolytic cell has an anodic compartment having an anolyte constituted of the pickling solution which has to be recovered in the bath, two cathodic compartments, the first of which has as catholyte the pickling solution for the separation treatment of the cations and wherein the reduction of the $Fe^{3+}$ ion to $Fe^{2+}$, or of $Ti^3$ and $Ti^{4+}$ to $Ti^{2+}$, occurs, and the second of which having as catholyte a solution of sulphuric acid and/or hydrochloric and/or phosphoric and wherein the hydrogen cathodic reaction occurs, and wherein said catholyte solution is sent to the pickling bath.

5. A method for pickling products of a metal alloy containing iron, and products of titanium and alloys hereof, according to claim 1, wherein the electrolytic cell has an anodic compartment with an anolyte constituted of a pickling solution to be recovered in the bath, a cathodic compartment having as catholyte the pickling solution for the separation treatment of the cations and wherein the reduction of the $Fe^{3+}$ ion to $Fe^{2+}$, or of $Ti^{3+}$ and $Ti^{4+}$ to $Ti^{2+}$, and, at the same time, the hydrogen cathodic reaction occurs.

6. A method for pickling products of a metal alloy containing iron according to claim 1, wherein the working electrochemical potential of the cell at the anode is comprised between 771 and 1229 mV SHE and the potential at the cathode is $\leqq$771 mV SHE.

7. A method for pickling products of titanium and alloys thereof, according to claim 1, wherein the working electrochemical potential of the cell at the anode is comprised between −502 and 1229 mV SHE and the potential at the cathode is $\leqq$368 mV SHE.

8. A method for pickling products of a metal alloy containing iron, and products of titanium and alloys thereof, according to claim 1, wherein the anodic reaction or, as an alternative, the cathodic reaction is potentiostatically or galvanostatically controlled.

9. A method for pickling products of a metal alloy containing iron, and products of titanium and alloys thereof according to claim 1, wherein the recovery of the pickling solution can be continuous by circulation of the pickling bath in the anolyte and the catholyte of the electrolytic cell, or discontinuous.

10. A method for pickling products of a metal alloy containing iron according to claim 1, wherein the pickling bath is substantially an aqueous solution containing the following materials:

free HCl from 0 to 50 g/l;

free $H_3PO_4$ from 0 to 200 g/l;

free $H_2SO_4$ from 50 to 250 g/l;

free HF from 5 to 50 g/l; and $Fe_{tot}$ ($Fe^{2+}$+$Fe^{3+}$) in solution $\geqq$50 g/l.

11. A method for pickling products of titanium and alloys thereof according to claim 1, wherein the anolyte is an aqueous solution containing:

free HCl from 0 to 50 g/l;

free H3PO4 from 0 to 200 g/l;

free $H_2SO_4$ from 50 to 250 g/l;

free HF from 5 to 50 g/l; and $Fe_{tot}$ ($Fe^{2+}$+$Fe^{3+}$) in solution $\geqq$50 g/l or, as an alternative $Ti_{tot}$ ($Ti^{2+}$+$Ti^{3+}$+$Ti^{4+}$) in solution $\geqq$50 g/l.

12. Apparatus for pickling products of a metal alloys containing iron, and products of titanium and alloys thereof, and for the recovery of the exhausted solutions deriving from pickling, comprising essentially the following units in combination:

a tank adapted to contain a pickling bath;

an electrolytic cell comprising an anodic compartment, at least one cathodic compartment, at least one anode, selected from the group consisting of graphite, carbon or lead-based, at least one cathode, selected from group consisting of graphite, lead, iron, stainless steel or Ni-based alloys and separation means between anolyte and catholyte;

a galvant a potentiostatic control device for the current of the cell;

means for sending the pickling solution to both the anodic and cathodic compartment;

means for separating the metal cations from the solution coming from the cathodic compartment to obtain a liquid deprived of said metal ions;

means for sending the solution coming from the anodic compartment to the pickling bath; and means for sending the liquid deprived of said metal ions to the pickling bath.

13. The apparatus as per claim 12, wherein the separation means between the solution coming out from the anodic compartment and the solution coming out from the cathodic compartment is a selective membrane.

14. The apparatus as per claim 12, wherein the means for separating the metal cations from the catholitic solution is selected from the group consisting of cryostat crystallisers, ion exchanging resins and selective membranes.

* * * * *